US011319633B2

(12) United States Patent
Rachiele et al.

(10) Patent No.: US 11,319,633 B2
(45) Date of Patent: May 3, 2022

(54) METAL SHEET TREATMENT METHOD AND METAL SHEET TREATED WITH THIS METHOD

(71) Applicant: ArcelorMittal, Luxembourg (LU)

(72) Inventors: Lydia Rachiele, Rombas (FR); Frida Gilbert, Antony (FR); Herve Derule, Montoy Flanville (FR)

(73) Assignee: ArcelorMittal, Luxembourg (LU)

( * ) Notice: Subject to any disclaimer, the term of this patent is extended or adjusted under 35 U.S.C. 154(b) by 32 days.

(21) Appl. No.: 16/649,246

(22) PCT Filed: Sep. 14, 2018

(86) PCT No.: PCT/IB2018/057047
§ 371 (c)(1),
(2) Date: Mar. 20, 2020

(87) PCT Pub. No.: WO2019/073320
PCT Pub. Date: Apr. 18, 2019

(65) Prior Publication Data

US 2020/0299844 A1 Sep. 24, 2020

(30) Foreign Application Priority Data

Oct. 12, 2017 (WO) ..... PCT/IB2017/001246

(51) Int. Cl.
*C23C 22/53* (2006.01)
*C23C 22/82* (2006.01)
(Continued)

(52) U.S. Cl.
CPC ..... *C23C 28/321* (2013.01); *C23C 2/06* (2013.01); *C23C 2/40* (2013.01); *C23C 22/53* (2013.01);
(Continued)

(58) Field of Classification Search
None
See application file for complete search history.

(56) References Cited

U.S. PATENT DOCUMENTS 6,528,182 B1 3/2003 Bello et al.
2008/0308192 A1* 12/2008 Bello ..... C23C 22/68 148/246
(Continued)

FOREIGN PATENT DOCUMENTS

CN 1715446 A 1/2006
CN 102839365 A 12/2012
(Continued)

OTHER PUBLICATIONS

See International Search Report of PCT/IB2018/057047, dated Oct. 24, 2018.

*Primary Examiner* — Alexander M Weddle
(74) *Attorney, Agent, or Firm* — Davidson, Davidson & Kappel, LLC

(57) ABSTRACT

A steel substrate is provided, coated on at least one of its faces with a metallic coating based on zinc or its alloys wherein the metallic coating is itself coated with a zincsulphate-based layer including at least one of the compounds selected from among zincsulphate monohydrate, zincsulphate tetrahydrate and zincsulphate heptahydrate, wherein the zincsulphate-based layer has neither zinc hydroxysulphate nor free water molecules nor free hydroxyl groups, the surface density of sulphur in the zincsulphate-based layer being greater than or equal to 0.5 mg/m$^2$. A corresponding treatment method is also provided.

16 Claims, 5 Drawing Sheets

(51) Int. Cl.

| | |
|---|---|
| ***C23C 28/00*** | (2006.01) |
| ***C23C 2/06*** | (2006.01) |
| ***C23C 2/40*** | (2006.01) |
| ***C23C 22/68*** | (2006.01) |

(52) U.S. Cl.

CPC ..... *C23C 22/68* (2013.01); *C23C 22/82* (2013.01); *C23C 28/3225* (2013.01); *C23C 28/34* (2013.01)

(56) References Cited

U.S. PATENT DOCUMENTS

| | | | | |
|---|---|---|---|---|
| 2010/0255341 | A1 | 10/2010 | Fujimoto et al. | |
| 2011/0226387 | A1 | 9/2011 | Fujita et al. | |
| 2015/0020562 | A1 | 1/2015 | Yamanaka et al. | |
| 2015/0093594 | A1* | 4/2015 | Chaleix ..... | C23C 22/53 428/639 |
| 2016/0138167 | A1 | 5/2016 | Chaleix et al. | |
| 2017/0145551 | A1 | 5/2017 | Girodani et al. | |
| 2017/0260471 | A1 | 9/2017 | Lostak et al. | |
| 2020/0216964 | A1 | 7/2020 | Rachiele et al. | |

FOREIGN PATENT DOCUMENTS

| | | | | |
|---|---|---|---|---|
| CN | 104093880 | A | 10/2014 | |
| CN | 104178757 | A | 12/2014 | |
| CN | 105358729 | A | 2/2016 | |
| CN | 106574353 | A | 4/2017 | |
| CN | 106687571 | A | 5/2017 | |
| EP | 2186925 | A1 | 5/2010 | |
| EP | 2366812 | A1 | 9/2011 | |
| EP | 2366812 | B1 * | 8/2019 | ..... C23C 18/1216 |
| JP | H 09-143755 | A | 6/1997 | |
| JP | 2000-256874 | A | 9/2000 | |
| JP | 2003-089881 | A | 3/2003 | |
| JP | 2003-306781 | A | 10/2003 | |
| JP | 2004-091901 | A | 3/2004 | |
| JP | 2006-083464 | A | 3/2006 | |
| JP | 2006083434 | A | 3/2006 | |
| JP | 2007-517135 | A | 6/2007 | |
| JP | 2009-079291 | A | 4/2009 | |
| JP | 2009-203547 | A | 9/2009 | |
| JP | 2015-504977 | A | 2/2015 | |
| JP | 2020537045 | A | 12/2020 | |
| WO | 0015878 | A1 | 3/2000 | |
| WO | 2019073319 | A1 | 4/2019 | |

* cited by examiner

METAL SHEET TREATMENT METHOD AND METAL SHEET TREATED WITH THIS METHOD

This invention relates to a metal sheet comprising a steel substrate that is coated on at least one of its faces with a metallic coating based on zinc or its alloys.

The invention concerns in particular the pre-lubrication of this coated steel substrate and its treatment in aqueous solutions containing sulphates.

BACKGROUND

Metal sheet of this type is intended in particular to be used for the fabrication of parts for automobiles, although it is not limited to those applications.

It is already known from WO00/15878 to treat a zinc-coated metal sheet with an aqueous solution comprising zinc sulfate to form a layer of zinc hydroxysulphate on the zinc-based coating. This conversion layer of zinc hydroxysulphate provides a pre-lubricated zinc-coated metal sheet with higher performances than those obtained by phosphating.

SUMMARY OF THE INVENTION

It has nevertheless been observed that this conversion layer based on zinc hydroxysulphate could offer unsufficient adhesion to adhesives used in the automotive industry, notably epoxy-based adhesives.

The aim of the present invention is to remedy the drawbacks (of the facilities and processes) of the prior art by providing a surface treatment offering sufficient adhesion to adhesives used in the automotive industry, notably epoxy-based adhesives.

It is an object of the present invention to provide a steel substrate coated on at least one of its faces with a metallic coating based on zinc or its alloys wherein the metallic coating is itself coated with a zincsulphate-based layer comprising at least one of the compounds selected from among zincsulphate monohydrate, zincsulphate tetrahydrate and zincsulphate heptahydrate, wherein the zincsulphate-based layer comprises neither zinc hydroxysulphate nor free water molecules nor free hydroxyl groups, the surface density of sulphur in the zincsulphate-based layer being greater than or equal to 0.5 mg/m$^2$.

The steel substrate may also have the optional features listed below, considered individually or in combination:

- the metallic coating based on zinc or its alloys comprises between 0.2% and 0.4% by weight aluminum, the rest being zinc and the unavoidable impurities resulting from the manufacturing process,
- the metallic coating based on zinc or its alloys comprises at least 0.1% by weight magnesium,
- the metallic coating based on zinc or its alloys comprises at least one element among magnesium up to a content of 10% by weight, aluminum up to a content of 20% by weight, silicon up to a content of 0.3% by weight,
- the surface density of sulphur in the zincsulphate-based layer is between 3.7 and 27 mg/m$^2$.

It is another object of the present invention to provide an automotive part made of a steel substrate according to the invention.

It is another object of the present invention to provide a treatment method for a moving metal strip comprising the steps according to which:

(i) a strip of steel coated on at least one of its faces with a metallic coating based on zinc or its alloys is provided, (ii) an aqueous treatment solution comprising at least 0.01 mol/L of zinc sulphate is applied to the metallic coating by simple contact so as to form a wet film, (iii) the aqueous treatment solution is subsequently dried in a dryer at a air drying temperature below 80° C., the time between the application of the aqueous treatment solution on the metallic coating and the exit of the dryer being less than 4 seconds, wherein the strip velocity, the wet film thickness, the initial strip temperature and the air flow rate are adapted to form, on the metallic coating, a zincsulphate-based layer comprising neither free water molecules nor free hydroxyl groups, the surface density of sulphur in the zincsulphate-based layer being greater than or equal to 0.5 mg/m$^2$.

The treatment method may also have the optional features listed below, considered individually or in combination:

- the metallic coating has been obtained by a hot-dip coating process in a bath of molten zinc eventually comprising at least one element among magnesium up to a content of 10% by weight, aluminum up to a content of 20% by weight, silicon up to a content of 0.3% by weight,
- the metallic coating is degreased before application of the aqueous treatment solution,
- the aqueous treatment solution contains between 20 and 160 g/L of zinc sulphate heptahydrate,
- the strip velocity is between 60 and 200 m/min,
- the wet film thickness is between 0.5 and 4 μm,
- the initial strip temperature is between 20 and 50° C.,
- the air flow rate is between 5000 and 50000 Nm$^3$/h.
- a film of oil with a coating weight of less than 2 g/m$^2$ is applied on the zincsulphate-based layer.

It has been surprisingly observed by the inventors that the presence of zinc hydroxysulphate itself in the conversion layer led to the weak adhesion of the treated metal sheet on some adhesives, notably epoxy-based adhesives.

Without being bound to any scientific theory, it is inventors' understanding that the hydroxyl groups of the zinc hydroxysulphate structure react with the epoxy system of the adhesive and lead to adhesion problems. In particular, their presence degrades the interfacial bonds zinc/epoxy and causes also the plasticization of the adhesive.

Excluding zinc hydroxysulphate from the layer composition is a priori not possible since it precipitates on the metallic coating, once the aqueous solution is applied on the metallic coating, as soon as the pH reaches 7 due to the metallic coating oxidation.

Moreover the inventors have observed that free water molecules and/or free hydroxyl groups can be present in the conversion layer even when it is apparently dry. These free water molecules and/or free hydroxyl groups are also very reactive with specific compounds of the adhesive such as, for example, epoxy-based compounds which leads to adhesion problems.

The inventors have done intensive research to obtain a layer excluding zinc hydroxysulphate and perfectly dried so as to obtain a layer with good adhesion to epoxy adhesives while preserving the other properties of the initial layer based on zinc hydroxysulphate.

From a product point of view, this research has revealed that good adhesion to epoxy adhesives was possible only if the conversion layer comprises neither zinc hydroxysulphate nor free water molecules nor free hydroxyl groups and only if the conversion layer comprised at least one of the compounds selected from among zincsulphate monohydrate, zincsulphate tetrahydrate and zincsulphate heptahydrate.

From a process point of view, this research has revealed that such a conversion layer could be obtained only if the air drying temperature in the dryer was carefully controlled so as to favor the formation of zincsulphate monohydrate, zincsulphate tetrahydrate or zincsulphate heptahydrate instead of other hydrates of zincsulphate. Moreover, it has been established that the strip velocity, the wet film thickness, the initial strip temperature and the air flow rate had to be adapted to the air drying temperature to perfectly dry the conversion layer and thus form a zincsulphate-based layer comprising neither free water molecules nor free hydroxyl groups. Moreover it has been established that the contact time of the aqueous solution on the metallic coating between the application of the solution and the end of the dryer had to be below 4 seconds to avoid the formation of zinc hydroxysulphate.

BRIEF DESCRIPTION OF THE DRAWINGS

Other characteristics and advantages of the invention will be described in greater detail in the following description.

The invention will be better understood by reading the following description, which is provided purely for purposes of explanation and is in no way intended to be restrictive, with reference to.

DETAILED DESCRIPTION

Figure 1:
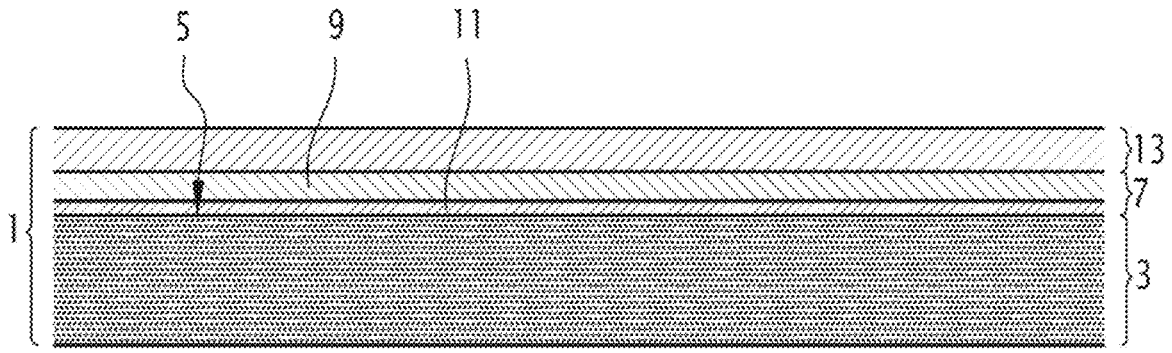
FIG. 1, which is a schematic sectional view illustrating the structure of the steel claimed by the invention, FIG. 2, which are IRRAS spectrums of the zincsulphate-based layer according to the invention and of the zinc hydroxysulphate layer of the prior art, FIG. 3, which are graphs illustrating in which conditions the metal strip is fully dry at the exit of the dryer depending on the strip velocity, the wet film thickness, the initial strip temperature, the air flow rate and the air drying temperature.

In FIG. 1, the metal sheet 1, in the form a metal strip, comprises a steel substrate 3, preferably hot-rolled and then cold-rolled, and that can be coiled, for example, for later use as a part for an automobile body, for example.

In this example, the metal sheet 1 is then unwound from the coil, then cut and shaped to form a part.

The substrate 3 is coated on one face 5 with a coating 7. In certain variants, a coating 7 of this type can be present on both faces of the substrate 3.

The coating 7 comprises at least one zinc-based layer 9. By "zinc-based" it is meant that the coating 7 can be zinc or its alloys, i.e. zinc comprising one or more alloying elements, such as for example but not being restricted thereto, iron, aluminium, silicon, magnesium and nickel.

This layer 9 generally has a thickness of less than or equal to 20 μm and is intended for the purpose of protecting the substrate 3 against perforating corrosion, in the conventional manner. It should be noted that the relative thicknesses of the substrate 3 and of the different layers that coat it are not drawn to scale in FIG. 1 to make the illustration easier to interpret.

In one variant of the invention, the zinc-based layer 9 comprises between 0.2% and 0.4% by weight aluminium, the rest being zinc and the unavoidable impurities resulting from the manufacturing process.

In one variant of the invention, the zinc-based layer 9 comprises at least 0.1% by weight magnesium to improve the resistance to corrosion. Preferably, the layer 9 contains at least 0.5% and more preferably at least 2% by weight magnesium. In this variant, the magnesium content is limited to 20% by weight in the layer 9 because it has been observed that a higher proportion would result in the excessively rapid consumption of the coating 7 and thus paradoxically in a degradation of the anti-corrosion action.

When the layer 9 contains zinc, magnesium and aluminum, it is particularly preferred if the layer 9 comprises between 0.1 and 10% by weight magnesium and between 0.1 and 20% by weight aluminum. Again preferably, the layer 9 comprises between 1 and 4% by weight magnesium and between 1 and 6% by weight aluminum.

In certain variants, the coating 7 can include an additional layer 11 between the layer 9 and the face 5 of the substrate 3. This layer can result, for example, from the heat treatment of a coating 7 comprising magnesium deposited under vacuum on zinc previously deposited, for example by electrodeposition, on the substrate 3. The heat treatment alloys magnesium and zinc and thereby forms a layer 9 that contains zinc and magnesium on top of a layer 11 that contains zinc.

The layer 9 can be obtained by a hot-dip coating process in a bath of molten zinc eventually comprising at least one element among magnesium up to a content of 10% by weight, aluminum up to a content of 20% by weight, silicon up to a content of 0.3% by weight. The bath can also contain up to 0.3% by weight of optional additional elements such as Sb, Pb, Ti, Ca, Mn, Sn, La, Ce, Cr, Ni, Zr or Bi.

These different elements can, among other things, improve the ductility or the adherence of the layer 9 to the substrate 3. A person skilled in the art who is familiar with their effects on the characteristics of the layer 9 will know how to use them as a function of the additional purpose sought.

Finally, the bath can contain residual elements originating from the ingots melted or resulting from the passage of the substrate 3 through the bath, such as iron in a content up to 0.5% by weight and generally between 0.1 and 0.4% by weight. These residual elements are partly incorporated into the layer 9, in which case they are designated by the term "unavoidable impurities resulting from the manufacturing process".

The layer 9 can also be deposited using a vacuum deposition process, such as, for example, magnetron sputtering or vacuum evaporation via the Joule effect, by induction or by an electron beam or jet vapor deposition.

The coating 7 is covered by a zincsulphate-based layer 13.

The layer 13 comprises at least one of the compounds selected from among zincsulphate monohydrate, zincsulphate tetrahydrate and zincsulphate heptahydrate and comprises neither zinc hydroxysulphate nor free water molecules nor free hydroxyl groups.

Zinc hydroxysulphate contains hydroxyl groups that, based on inventors' understanding, react with the epoxy system of the adhesive and lead to adhesion problems. Its absence significantly improves the adhesion of epoxy-based adhesives on metal sheets. By zinc hydroxysulphate, it is meant the compound of general formula:

$$[Zn_x(SO_4)_y(OH)_z, tH_2O]$$

where 2x=2y+z, with y and z different from zero.

z is preferably higher than or equal to 6, and more preferably z=6 and 3≤t≤5. In particular, compound with x=4, y=1, z=6 and t=3 has been observed on metal sheets from the prior art.

Free water molecules and free hydroxyl groups are also very reactive with specific compounds of the adhesive such as, for example, epoxy-based compounds which leads to adhesion problems. Their absence significantly improves the adhesion of epoxy-based adhesives on metal sheets.

Zincsulphate monohydrate, zincsulphate tetrahydrate and zincsulphate heptahydrate are stable compounds. Thanks to their presence, a later development of zinc hydroxysulphate by decomposition of unstable zincsulphate hydrates is avoided.

The surface density of sulphur in the zincsulphate-based layer 13 is greater than or equal to 0.5 mg/m$^2$. Below this value, the metallic coating 7 deteriorates while the metal sheet is formed, which results in the formation of powder or particles of zinc or its alloys at the surface of the metal sheet. The accumulation and/or agglomeration of these particles or this powder in the forming tools may damage the formed parts, by the formation of barbs and/or constrictions.

The zincsulphate-based layer 13 can be obtained by the application to the coating 7, possibly after degreasing, of an aqueous treatment solution containing zinc sulphate $ZnSO_4$ in a concentration greater than or equal to 0.01 mol/L.

It is not possible to form such a layer 13 when the concentration of zinc sulphate is less than 0.01 mol/L, but it has also been found that a too high concentration does not significantly improve the rate of deposition and may even slightly reduce it.

The aqueous treatment solution can be prepared by dissolving zinc sulfate in pure water. For example, zinc sulfate heptahydrate ($ZnSO_4$, 7 $H_2O$) can be used. The concentration of $Zn^{2+}$ ions is then equal to the concentration of $SO_4^{2-}$ anions.

The aqueous treatment solution used preferably contains between 20 and 160 g/L of zinc sulphate heptahydrate, which corresponds to a concentration of $Zn^{2+}$ ions and a concentration of $SO_4^{2-}$ ions between 0.07 and 0.55 mol/L. It has been found that in this range of concentration the rate of deposition is not significantly influenced by the value of the concentration.

The pH of the aqueous treatment solution preferably corresponds to the natural pH of the solution, without the addition of either base or acid. The value of this pH is generally between 4 and 7.

The temperature of the aqueous treatment solution is between 20 and 60° C.

The aqueous treatment solution is applied in the conventional manner, e.g., by dipping, roll-coating, spraying eventually followed by squeezing.

The contact time of the aqueous treatment solution with the coating 7 is less than 4 seconds. By "contact time" it is meant the time between the application of the aqueous treatment solution on the metal sheet (e.g. entry of the metal sheet in the treatment bath or application on the metal sheet of the roller of the roll-coating apparatus) and the exit of the dryer. Above this limit of 4 seconds, the pH has time to rise above the precipitation limit of zinc hydroxysulphate, which leads to the detrimental deposition of this compound on the metal sheet during the production of the zincsulphate-based layer.

Figure 2:
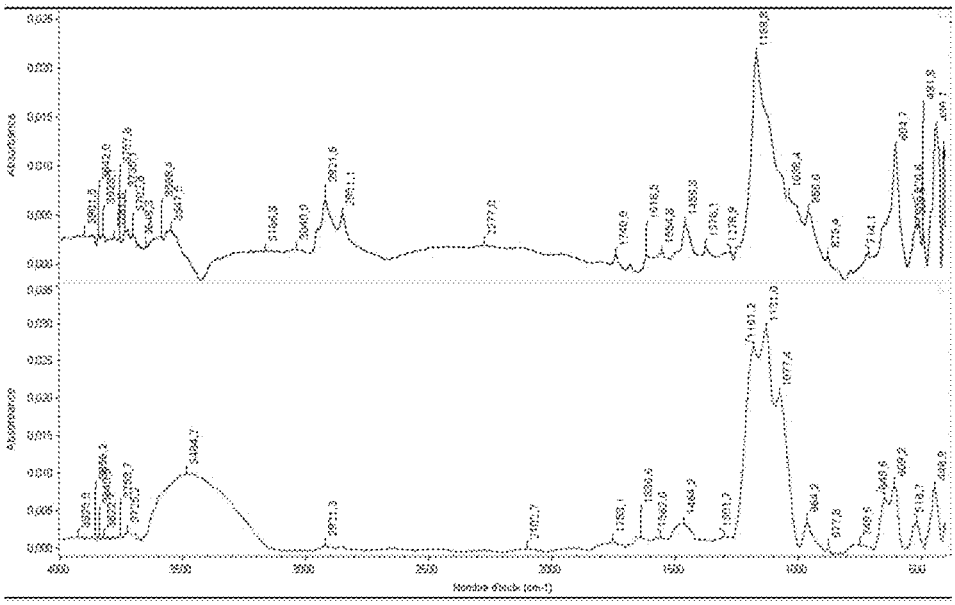

From a practical point of view, the absence of zinc hydroxysulphate can be controlled by infrared spectroscopy in IRRAS mode (Infrared Reflection-Adsorption spectroscopy with an incidence angle of 80°). As illustrated in the lower part of FIG. 2, if the zincsulphate-based layer comprises zinc hydroxysulphate, the IRRAS spectrum presents multiple absorption peaks assigned to the $\upsilon_3$ sulphate vibrations 1077-1136-1177 cm$^{-1}$ and active water bands in the OH stretching region 3000-3400 cm$^{-1}$. These results match the hydroxyzincsulphate structure as indicated in the literature ($\upsilon_1$ sulphate vibration: 1000 cm$^{-1}$, $\upsilon_2$ sulphate vibration: 450 cm$^{-1}$, $\upsilon_3$ sulphate vibrations: 1068-1085-1130 cm$^{-1}$, $\upsilon_4$ sulphate vibrations: 611-645 cm$^{-1}$, hydroxyl vibration: 3421 cm$^{-1}$).

The air drying temperature in the dryer is adapted to favor the formation of zincsulphate monohydrate, zincsulphate tetrahydrate or zincsulphate heptahydrate instead of other hydrates of zincsulphate. It has been surprisingly observed that a air drying temperature below 80° C. favors the development of these compounds.

Thanks to the presence of these stable compounds, a later development of zinc hydroxysulphate by decomposition of unstable zincsulphate hydrates is avoided.

From a practical point of view, the presence of these stable zincsulphate hydrates can be controlled by infrared spectroscopy in IRRAS mode (Infrared Reflection-Adsorption spectroscopy with an incidence angle of 80°). As illustrated in the upper part of FIG. 2, if the zincsulphate-based layer comprises stable zincsulphate hydrates without zinc hydroxysulphate, the IRRAS spectrum presents one single sulphate peak located around 1172 cm$^{-1}$ instead of 3 peaks. More specifically, the presence of each of these stable zincsulphate hydrates can be controlled by infrared spectroscopy in IRRAS mode coupled to Differential Scanning calorimetry (DSC) by tracking the sulphate bands and free water bands.

The strip velocity, the wet film thickness, the initial strip temperature and the air flow rate are adapted to form, on the metallic coating, a zincsulphate-based layer comprising neither free water molecules nor free hydroxyl groups, the surface density of sulphur in the zincsulphate-based layer being greater than or equal to 0.5 mg/m$^2$. Preferably, the surface density of sulphur in the zincsulphate-based layer is between 3.7 and 27 mg/m$^2$.

The wet film thickness can be measured with an infrared gauge positioned before the dryer. It is composed of a light source, an infrared detector and specific filters. The measurement principle is based on infrared light absorption.

The air flow rate is defined as the quantity of air blown per second in the whole dryer and impacting the metal strip. Consequently, the configuration of the nozzles in the dryer can vary notably in terms of quantity, size, design, position, . . . .

Preferably the dryer comprises between 6 and 12 nozzles to better distribute the air jet impingement on the metal strip. Preferably the dryer comprises nozzles positioned between 4 and 12 cm from the metal strip to avoid pressure loss in the jet without removing the wet film from the metal strip. Preferably the nozzles have openings which width is comprised between 2 mm and 8 mm so as to optimize the air velocity at the nozzle exit.

At the exit of the dryer, the absence of water in the zincsulphate-based layer can be controlled notably with a hyperspectral camera. This latter is made of an infrared matrix detector coupled to a spectrometer which disperses the light into wavelengths. The measurement apparatus may be composed of a linear shape IR lamp (800 mm length) and a MWIR (Mid-Wave IR) hyperspectral camera in bidirectional reflection configuration. The detection range of the camera is 3-5 μm which corresponds to the main absorption bands of liquid water. The measurement principle consists in measuring the intensity of light reflected off the metal strip. If water remains in the zincsulphate-based layer, it absorbs a part of the light and less intensity is reflected.

In a variant, the absence of water in the zincsulphate-based layer at the exit of the dryer is controlled by monitoring the temperature of the steel strip in the dryer. As long as there is water in the film, the thermal energy of hot air is spent for evaporating water and the temperature of the metal strip remains constant or even decreases due to water evaporation. Once the film is dry, the thermal energy of hot air is spent for heating the metal strip. By monitoring the temperature of the steel strip in the dryer, it is thus easy to control that the temperature of the metal strip starts to increase before the exit of the dryer.

In a variant, the absence of water in the zincsulphate-based layer at the exit of the dryer is controlled by infrared spectroscopy in IRRAS mode (Infrared Reflection-Adsorption spectroscopy with an incidence angle of 80°). As illustrated in the lower part of FIG. 2, if the zincsulphate-based layer comprises free water, the IRRAS spectrum presents peaks located around 1638 and 1650 $cm^{-1}$.

The absence of free hydroxyl groups in the zincsulphate-based layer at the exit of the dryer is controlled by infrared spectroscopy in IRRAS mode (Infrared Reflection-Adsorption spectroscopy with an incidence angle of 80°). As illustrated in the lower part of FIG. 2, if the zincsulphate-based layer comprises free hydroxyl groups, the IRRAS spectrum presents a peak located at 3600 $cm^{-1}$.

The process of drying is fundamentally a simultaneous heat and mass transfer operation in which the energy to evaporate a liquid from a solution is provided in the drying air. Hot air is thus used both to supply the heat for evaporation and to carry away the evaporated moisture from the product. The external conditions (strip velocity, initial wet film thickness, initial strip temperature, air flow rate) are the key parameters controlling this phenomenon.

The parameters are interdependent. This is mainly caused by a complex nature of the phenomenon as change of a single parameter, e.g. varying air drying temperature, induces changes on other parameters, e.g. air flow rate. It is thus difficult to identify all the domains for which the zincsulphate-based layer comprises neither free water molecules nor free hydroxyl groups. Nevertheless, the man skilled in the art will know how to adjust the parameters based on the examples described below.

Example 1

Figure 3:
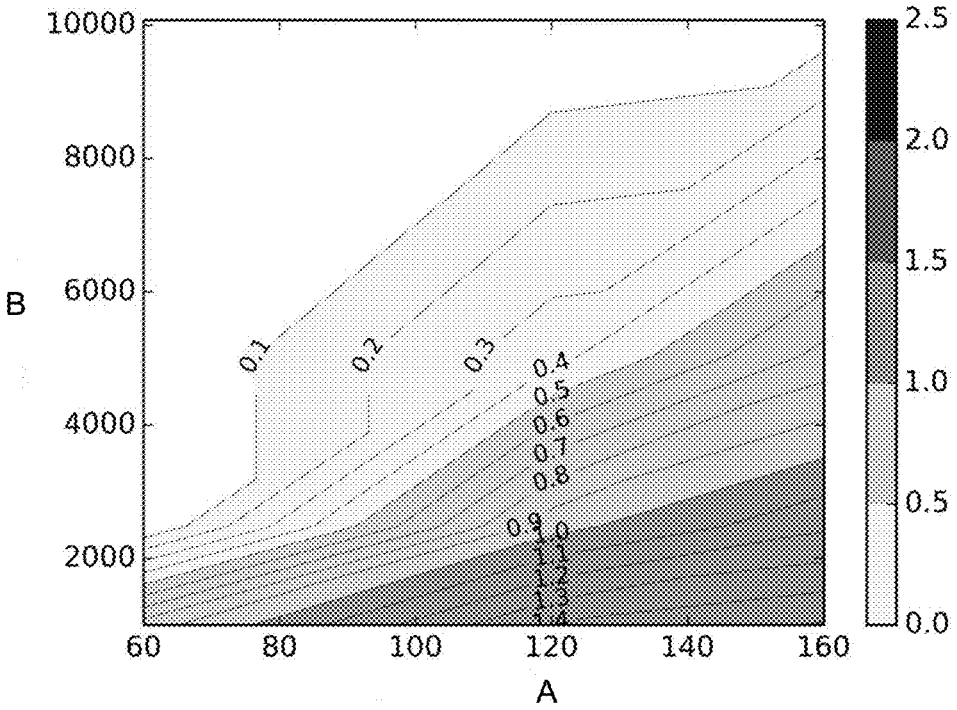
Figure 3:
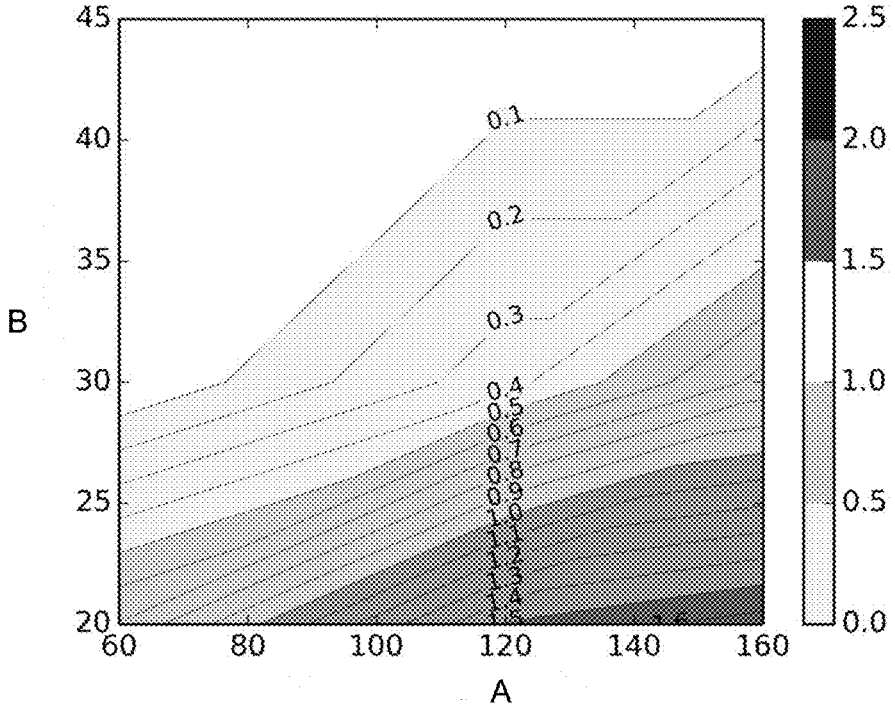
Figure 3:
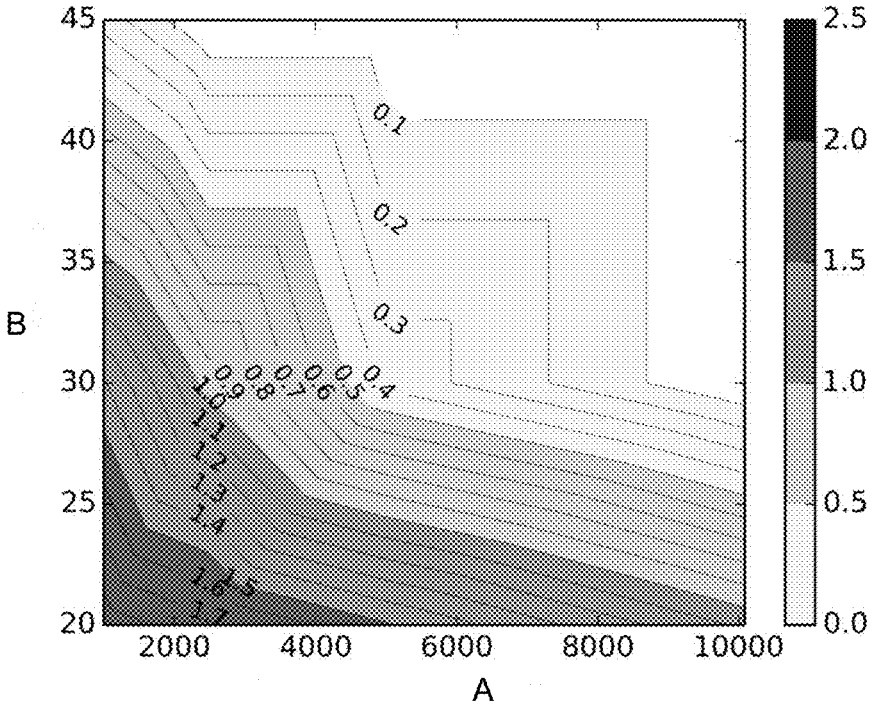
Figure 3:
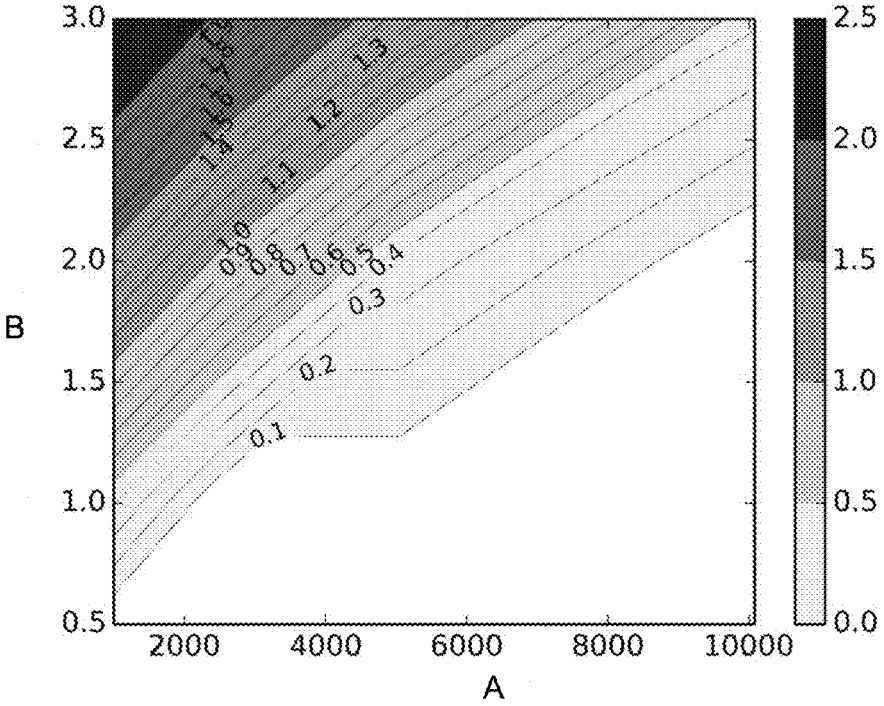
Figure 3:
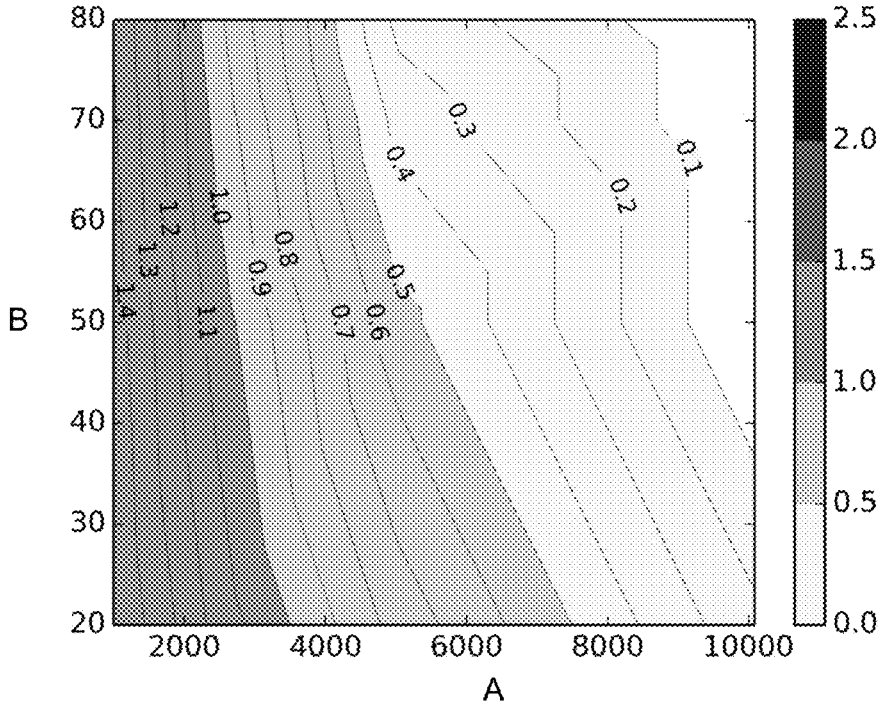

As illustrated on FIG. 3 *a*), the domain for which the zincsulphate-based layer is dry at the end of the dryer is given depending on strip velocity (A in m/min) and air flow rate (B in $Nm^3/h$). Level lines correspond to the thickness of the water film at the exit of the dryer. Zincsulphate-based layer is thus dry for conditions above level line 0.1 μm (white area).

These results were obtained in the following conditions:
Air drying temperature: 70° C.
Initial strip temperature: 30° C.
Initial film thickness: 2 μm
Contact time: <4 seconds Example 2

As illustrated on FIG. 3 *b*), the domain for which the zincsulphate-based layer is dry at the end of the dryer is given depending on strip velocity (A in m/min) and initial strip temperature (B in ° C.).

These results were obtained in the following conditions:
Air drying temperature: 70° C.
Air flow rate: 5000 $Nm^3/h$
Initial film thickness: 2 μm
Contact time: <4 seconds Example 3

As illustrated on FIG. 3 *c*), the domain for which the zincsulphate-based layer is dry at the end of the dryer is given depending on air flow rate (A in $Nm^3/h$) and strip temperature (B in ° C.).

These results were obtained in the following conditions:
Air drying temperature: 70° C.
Strip velocity: 120 m/min
Initial film thickness: 2 μm
Contact time: <4 seconds Example 4

As illustrated on FIG. 3 *d*), the domain for which the zincsulphate-based layer is dry at the end of the dryer is given depending on air flow rate (A in $Nm^3/h$) and initial film thickness (B in μm).

These results were obtained in the following conditions:
Air drying temperature: 70° C.
Strip velocity: 120 m/min
Initial strip temperature: 30° C.
Contact time: <4 seconds Example 5

As illustrated on FIG. 3 *e*), the domain for which the zincsulphate-based layer is dry at the end of the dryer is given depending on air flow rate (A in $Nm^3/h$) and air drying temperature (B in ° C.).

These results were obtained in the following conditions:
Initial strip temperature: 30° C.
Strip velocity: 120 m/min
Initial film thickness: 2 μm
Contact time: <4 seconds Preferably, the strip velocity is between 60 and 200 m/min. Preferably the wet film thickness is between 0.5 and 4 μm. Preferably the initial strip temperature is between 20 and 50° C. Preferably the air flow rate is between 5000 and 50000 $Nm^3/h$.

After the formation of the layer 13 on the surface, the layer 13 can optionally be lubricated.

This lubrication can be performed by applying a film of oil (not shown) with a coating weight of less than 2 $g/m^2$ on the layer 13.

As will be seen in the following non-restricting examples, which are presented exclusively by way of illustration, the inventors have shown that the presence of a layer 13 makes it possible to improve the adhesion to adhesives used in the automotive industry, notably epoxy-based adhesives without degrading the other performances, such as corrosion resistance and drawability.

Figure 4:
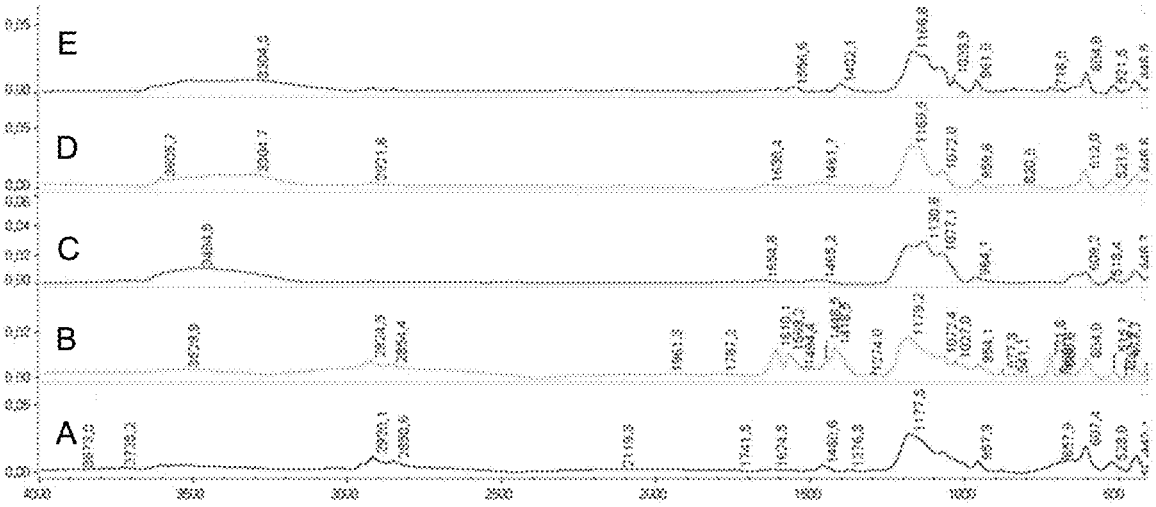
FIG. 4 shows that only samples A and B present a single sulphate peak around 1172 $cm^{-1}$ assigned to stable zincsulphate hydrates. Samples C, D and E present multiple absorption peaks assigned to the $\nu_3$ sulphate vibrations of the hydroxyzincsulphate structure, and FIG. 5 in which each column represents the percentage of cohesive failure (in black) at initial stage (H0) and after 7 days in cataplasm test (H7).

The effect of the different parameters on the absence of zinc hydroxysulphate was assessed by applying an aqueous treatment solution comprising between 50 and 130 g/L of zinc sulphate heptahydrate on a galvanized steel and by drying the wet film within 4 seconds using the following conditions:

Sample A:
- Air drying temperature: 65° C.
- Strip velocity: 100 m/min
- Initial strip temperature: 30° C.
- Initial film thickness: 2 μm
- Air flow rate: 10000 $Nm^3/h$ Sample B:
- Air drying temperature: 70° C.
- Strip velocity: 180 m/min
- Initial strip temperature: 40° C.
- Initial film thickness: 1 μm
- Air flow rate: 35000 $Nm^3/h$ Sample C:
- Air drying temperature: 110° C.,
- Strip velocity: 100 m/min
- Initial strip temperature: 30° C.
- Initial film thickness: 3 μm
- Air flow rate: 45000 $Nm^3/h$ Sample D:
- Air drying temperature: 140° C.,
- Strip velocity: 110 m/min
- Initial strip temperature: 30° C.
- Initial film thickness: 2 μm
- Air flow rate: 12000 $Nm^3/h$ Sample E:
- Air drying temperature: 150° C.,
- Strip velocity: 120 m/min
- Initial strip temperature: 22° C.
- Initial film thickness: 3 μm
- Air flow rate: 8300 $Nm^3/h$ The composition of the zincsulphate-based layer was assessed by IRRAS infrared spectroscopy. As illustrated in FIG. 4, only samples A and B present a single sulphate peak around 1172 $cm^{-1}$ assigned to stable zincsulphate hydrates. Samples C, D and E present multiple absorption peaks assigned to the $\upsilon_3$ sulphate vibrations of the hydroxyzincsulphate structure.

The adhesion of epoxy-based adhesives on the zincsulphate-based layer formed on samples A to E was evaluated by a single lap shear test. At first, test pieces 100 mm long and 25 mm wide were re-oiled using Anticorit Fuchs 3802-39S (1 $g/m^2$) without being degreased. Two test pieces, one treated with the aqueous treatment solution and one untreated, were then assembled with the epoxy-based adhesive Teroson® 8028 GB from Henkel® by overlapping them on 12.5 mm long using teflon shims in order to maintain an homogeneous thickness of 0.2 mm between the two pieces. The whole assembly was cured in the oven for 20 minutes at 190° C. The samples were then conditioned for 24 h before adhesion test and ageing test. For each test condition, 5 assemblies were tested.

The adhesion has been assessed according to DIN EN 1465 standard. In this test, each bonded assembly is fixed in the clamping jaws (gripping 50 mm of each test piece in each clamp and leaving 50 mm of each test piece free) of a tensile machine using cell force of 50 KN. The samples are pulled at a rate of 10 mm/min, at room temperature. The maximal shear stress values are recorded in MPa and the failure pattern is visually classified as:

- cohesive failure if the tear appears in the bulk of the adhesive,
- superficial cohesive failure is the tear appears in the bulk of the adhesive close to the strip/adhesive interface,
- adhesive failure if the tear appears at the strip/adhesive interface.

The test is not passed if adhesive failure is observed.

The ageing of the adhesion has been assessed by cataplasm test. In this test, each bonded assembly (5 specimens each time) is wrapped in cotton (weight of 45 g+/−5) with deionized water (10 times the weight of cotton), put in polyethylene bag which is then sealed. The sealed bag is kept in the oven at 70° C., 100% HR for 7 days. Once the cataplasm test has been performed, the adhesion is reassessed according to DIN EN 1465 standard.

Figure 5:
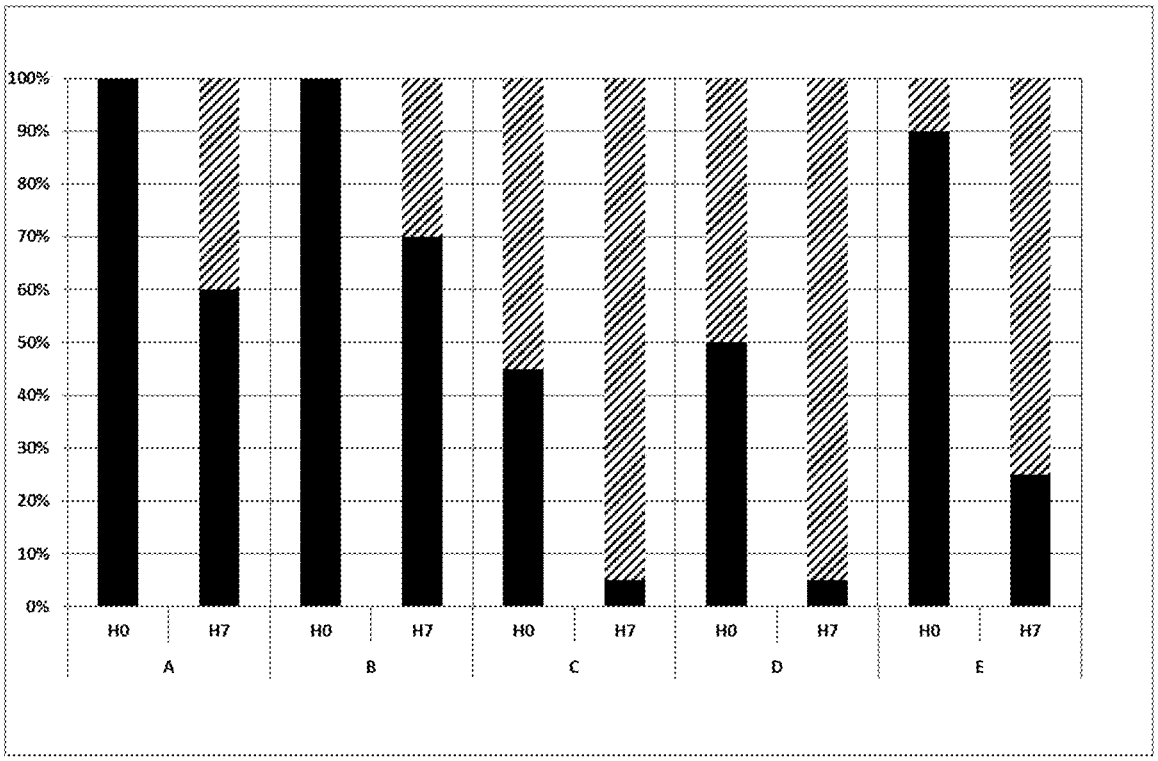

The obtained results are illustrated in FIG. 5 where each column represents the percentage of cohesive failure (in black) at initial stage (H0) and after 7 days in cataplasm test (H7).

As illustrated, only samples A and B present a good adhesion at initial stage and a low degradation of the performances after 7 days in cataplasm test.

The temporary protection of the test pieces was evaluated by a test performed in humidity and temperature controlled corrosion-test chamber, as specified by DIN EN ISO 6270-2 following application on the layers 13 of the protection oil Fuchs (registered trademark) 3802-39S with a coating weight of approximately 1 $g/m^2$.

In a test performed in a humidity and temperature controlled corrosion-test chamber in accordance with DIN EN ISO 6270-2, the test pieces are subjected to two aging cycles of 24 hours in a humidity and temperature controlled corrosion-test chamber, i.e., an enclosure with a controlled atmosphere and temperature. These cycles simulate the corrosion conditions of a coil of strip or a strip cut into sheets during storage. Each cycle includes:

- a first phase of 8 hours at 40° C.±3° C. and at approximately 98% relative humidity, followed by
- a second phase of 16 hours at 21° C.±3° C. and at less than 98% relative humidity.

After 4 cycles, no degradation must be visible.

After 10 cycles, less than 10% of the surface of the test pieces must be visually altered.

The tests performed on the test pieces confirmed the good behavior of the surface treatment according to the invention in term of temporary protection.

What is claimed is:

1. A treatment method for a moving metal strip comprising the steps according to which:

- providing a strip of steel coated on at least one face with a metallic coating based on zinc or a zinc alloy;
- applying an aqueous treatment solution including at least 0.01 mol/L of zinc sulphate to the metallic coating by simple contact so as to form a wet film; and
- subsequently drying the aqueous treatment solution in a dryer at an air drying temperature at an air drying temperature below 80° C., a time between the application of the aqueous treatment solution on the metallic coating and an exit at the dryer being less than 4 seconds, wherein a strip velocity, a wet film thickness, an initial strip temperature and an air flow rate are adapted to form, on the metallic coating, a zincsulphate-based layer including neither free water molecules nor free hydroxyl groups, a surface density of sulphur in the zincsulphate-based layer being greater than or equal to 0.5 $mg/m^2$.

2. The treatment method as recited in claim 1 wherein the metallic coating has been obtained by a hot-dip coating process in a bath of molten zinc eventually comprising at least one element among magnesium up to a content of 10% by weight, aluminum up to a content of 20% by weight, silicon up to a content of 0.3% by weight.

3. The treatment method as recited in claim 1 further comprising degreasing the metallic coating before application of the aqueous treatment solution.

4. The treatment method as recited in claim 1 wherein the aqueous treatment solution contains between 20 and 160 g/L of zinc sulphate heptahydrate.

5. The treatment method as recited in claim 1 wherein the strip velocity is between 60 and 200 m/min.

6. The treatment method as recited in claim 1 wherein the wet film thickness is between 0.5 and 4 μm.

7. The treatment method as recited in claim 1 wherein the initial strip temperature is between 20 and 50° C.

8. The treatment method as recited in claim 1 wherein the air flow rate is between 5000 and 50000 $Nm^3/h$.

9. The treatment method as recited in claim 1 further comprising applying a film of oil with a coating weight of less than 2 $g/m^2$ on the zincsulphate-based layer.

10. A method for making an automotive part comprising performing the treatment method as recited in claim 1.

11. A coated steel product treated by the treatment method as recited in claim 1 and comprising:

the strip of steel coated on at least one face with the metallic coating based on zinc or a zinc alloy; and the zincsulphate-based layer coating the metallic coating, the zincsulphate-based layer comprising the at least one of the compounds selected from the group consisting of: zincsulphate monohydrate, zincsulphate tetrahydrate and zincsulphate heptahydrate, the zincsulphate-based layer comprising neither zinc hydroxysulphate nor free water molecules nor free hydroxyl groups, and the surface density of sulphur in the zincsulphate-based layer being greater than or equal to 0.5 $mg/m^2$.

12. The coated steel product as recited in claim 11 wherein the metallic coating includes between 0.2% and 0.4% by weight aluminum, a rest being zinc and the unavoidable impurities resulting from the manufacturing process.

13. The coated steel product as recited in claim 11 wherein the metallic coating includes at least 0.1% by weight magnesium.

14. The coated steel product as recited in claim 13 wherein the metallic coating includes at least one element of the following: magnesium up to a content of 10% by weight, aluminum up to a content of 20% by weight, and silicon up to a content of 0.3% by weight.

15. The coated steel product as recited in claim 11 wherein the surface density of sulphur in the zincsulphate-based layer is between 3.7 and 27 $mg/m^2$.

16. An automotive part made of the coated steel product as recited in claim 11.

* * * * *